United States Patent [19]

Forde

[11] 4,064,858

[45] Dec. 27, 1977

[54] IGNITION SYSTEM WITH MULTIPLEX DISTRIBUTOR FOR ENGINES

[76] Inventor: Louis Forde, 482 Berriman St., Brooklyn, N.Y. 11208

[21] Appl. No.: 750,274

[22] Filed: Dec. 13, 1976

Related U.S. Application Data

[63] Continuation-in-part of Ser. No. 665,125, Aug. 5, 1976, abandoned, which is a continuation-in-part of Ser. No. 482,232, June 24, 1974, abandoned.

[51] Int. Cl.[2] ..... F02P 1/00; F02P 5/04; H01H 29/16

[52] U.S. Cl. ..... 123/148 DS; 123/117 R; 123/148 C; 123/146.5 A; 200/19 R

[58] Field of Search ..... 123/117 R, 146 SA, 148 DS, 123/148 C; 200/19 R, 19 DR, 19 DC

[56] References Cited

U.S. PATENT DOCUMENTS

| | | | |
|---|---|---|---|
| 2,215,106 | 9/1940 | LeFebre | 123/148 DS |
| 2,285,107 | 6/1942 | Bohli | 123/148 DS |
| 2,756,268 | 7/1956 | Knudson | 123/148 DS |
| 3,577,963 | 5/1971 | Bechmann | 123/117 R |
| 3,890,947 | 6/1975 | Shibagaki | 123/148 DS |

FOREIGN PATENT DOCUMENTS

| | | | |
|---|---|---|---|
| 43-17125 | 10/1965 | Japan | 123/148 DS |

*Primary Examiner*—Ronald B. Cox

[57] ABSTRACT

An ignition distributor is described for use in an internal combustion engine which has a plurality of cylinders or combustion chambers. The distributor includes a driving shaft with a number of rotatable cams mounted on the shaft in an axially spaced arrangement. Each of the cams have lobes on them. A corresponding plurality of substantially identical and concurrently operable circuit breaker assemblies are disposed in an axially spaced apart arrangement. A multi-level rotor is positioned on the shaft, with each level associated with a respective one of the circuit breaker assemblies. An ignition coil is provided for each assembly. The primary of the ignition coil is connected to a respective one of the circuit breaker assemblies and the secondary is connected through the corresponding level of the rotor to a spark plug. Each assembly includes an actuating cam follower, and all of the cam followers are pivoted about the same pivot line and onto a common ground plate. Each cam follower engages a respective one of the rotatable cams.

12 Claims, 16 Drawing Figures

IGNITION SYSTEM WITH MULTIPLEX DISTRIBUTOR FOR ENGINES

BACKGROUND OF THE INVENTION

This invention is a continuation-in-part of Ser. No. 665,125 filed on Aug. 5, 1976, now abandoned which was a continuation-in-part of Ser. No. 482,232 filed June 24, 1974, now abandoned.

This invention relates to an automobile ignition system and more particularly to an improved multi-coil ignition distributor.

In internal combustion engines, a distributor is used for conveying electrical current to the spark plugs according to a particular firing order. The distributor includes a longitudinal drive shaft whose lower end is connected to the crankshaft of the engine. This drive shaft carries the ignition cam which actuate a breaker point assembly which is mounted on a breaker plate. Fitted to the upper end of the shaft is the distributor rotor through which an electric wire passes. The distributor cover of the housing has, at its center, a carbon brush through which the current is passed to the distributor rotor. At the edge of the rotor disc are a number of contacts, one for each cylinder of the engine. These are so arranged that the rotor is always at a contact just when the contact breaker points are opened. When the contact breaker points are closed, current flows through the ignition coil primary windings to create a magnetic field. When the contact breaker points are open, the magnetic field collapses rapidly to induce a high voltage in the coil secondary windings which is applied to one of the spark plugs through the contacts in the distributor rotor disc. The amount of energy stored in the magnetic field of the coil during the time the points are closed determines the output voltage of the coil secondary.

Conventional distributors utilize a single coil ignition system for all of the cylinders. Such systems, therefore, utilize a single breaker point assembly which contacts the cam and wherein the number of lobes on the cam equals the number of cylinders in the engine. With engines having many cylinders and being run at high speeds, the dwell time during which the primary builds up the magnetic field is extremely limited and accordingly there is frequently insufficient voltage generated to properly fire the spark plugs. Also, because only a single breaker point assembly is utilized, at higher speeds there will be a tendency to have the breaker point assembly wear down and there is also an increased possibility of ignition failure due to the bouncing of the contact points.

To alleviate this problem, there has been introduced in the prior art a dual point ignition system wherein two ignition coils are utilized alternately. To accommodate the two coils, there is provided two breaker point assemblies which are mounted on the breaker plate and circumferentially spaced about the shaft. The angular spacing between the breaker point assemblies is critical since it is necessary that one of the breakers have its cam follower engaging a lobe while the other cam follower is engaging a dwell. This requires that the angular relationship between the breaker point assemblies be dependent upon the angular spacing between adjacent lobes on the cam.

Other prior art systems which utilize two ignition coils have placed them in series wherein both coils act simultaneously and dependently. Furthermore, even in those prior art systems which did use multiple coils and multiple breaker points, only a single rotor was utilized so that the coils were still tied into each other and acted in a simultaneous manner.

While such distributors are readily available, they have generally been expensive since the number of parts is greatly increased over the conventional single coil ignition system and more complex wiring is needed. Furthermore, in order to change from a single coil to a dual point ignition system it is necessary to replace the entire distributor assembly since the breaker plate must be modified to accommodate more than one breaker point assembly. Additionally, in order to permit both simultaneous as well as alternate actuation of the ignition coils, complex gear and ratchet systems were utilized to provide a cam arrangement wherein part of the cam could be retracted into an inoperative position during a part of the operation of the engine. A further problem with existing dual point systems relates to the dwell time during which the magnetic field builds up. With conventional dual point systems the dwell time is generally fixed and equal between successive ignition sparks, therefore, such systems have not been available for engines requiring irregular firing cycles which need unequal dwell times between ignition sparks.

SUMMARY OF THE INVENTION

It is accordingly an object of the present invention to provide an ignition distributor which avoids the aforementioned problems of prior art devices.

A further object of the present invention is to provide an ignition distributor which is reduced in cost, provides longer life and gives better overall performance than conventional devices.

Another object of the present invention is to provide an ignition distributor with a multiple breaker point assembly in combination with a multiple cam arrangement and a multiplicity of ignition coils.

Still a further object of the present invention is to provide an ignition distributor for use with a multiplicity of ignition coils and which permits the ignition coils to operate simultaneously or alternately.

Another object of the present invention is to provide an ignition distributor which includes a plurality of coils, a corresponding plurality of breaker point assemblies, a corresponding plurality of cams on the distributor shaft and a rotor having a corresponding plurality of levels, whereby the operation of each ignition coil can be connected to provide for simultaneous, alternate, phase shifted, or temperature adjustable operation of the coils.

A further object of the present invention is to provide an ignition distributor which permits varying of the firing angle between successive ignition sparks.

Yet another object of the present invention is to provide an ignition distributor which finds particular use in compound vortex controlled combustion engines (CVCC).

A further object of the present invention is to provide an improved ignition distributor for use with multiple ignition coils and which can use the standard breaker plate used for single coil systems.

Briefly, the present invention provides an ignition distributor for an internal combustion engine having a plurality of cylinders. The distributor includes a driving shaft with a plurality of rotatable cam means mounted on the shaft in an axially spaced arrangement, each cam means having a number of lobes. A corresponding plurality of substantially identical and concurrently operable circuit breaker assemblies are disposed in an axially spaced apart arrangement. A multi-level rotor is provided on the shaft, each level associated with a corresponding one of the circuit breaker assemblies. A corresponding plurality of ignition coils are provided, wherein the primary of each coil is connected to a respective one of the assemblies and its secondary connected to the corresponding rotor level. Each of the circuit breaker assemblies include an actuating cam follower. All of the cam followers are pivoted about the same pivot line and onto a common ground plate. Each cam follower engages a respective one of the rotatable cam means.

For simultaneous operation of the coils, the cams are axially aligned and each cam would have a number of lobes equal to the number of cylinders. For sequential operation, the cams are axially displaced and the number of cylinders would be equally divided among the cams assemblies. For controlling flame propagation, each cam would have a number of lobes equal to the number of cylinders, but the cams would be angularly skewered with respect to each other, the angle providing the phase difference in the successive firings within each cycle.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
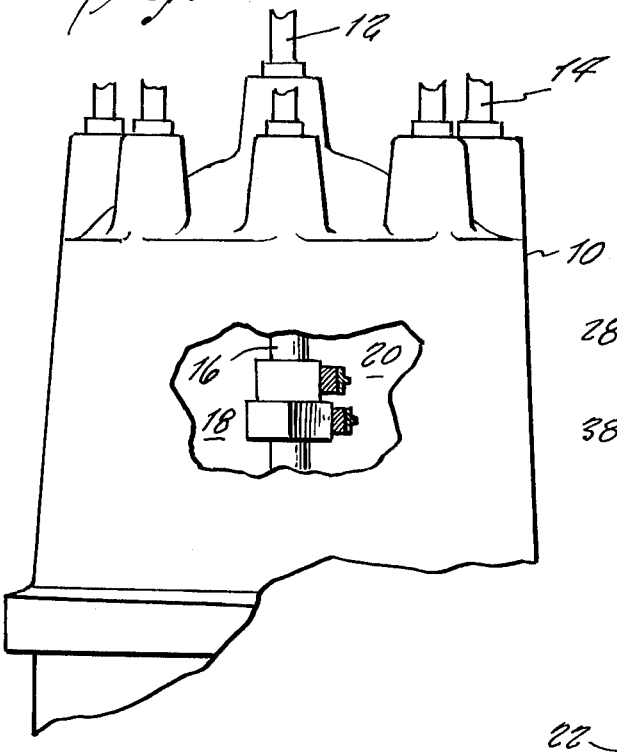
FIG. 1 is a partly cut-away elevational view of an ignition distributor showing one aspect of the present invention.

Referring now to FIG. 1, there is shown a conventional distributor cap 10 having a central terminal 12 which is coupled to the distributor rotor, and a plurality of peripheral terminals 14 which connect to contact electrodes in the distributor cap and lead to the spark plugs. The number of peripheral terminals is generally the same as the number of spark plugs in the engine. Inside the distributor cap, which is partially cut-away, is shown the driving shaft 16 which would be connected to the crank-shaft in the engine block. Mounted onto the driving shaft is the cam arrangement, shown generally at 18, and the cam follower arrangement shown generally at 20.

Figure 2:
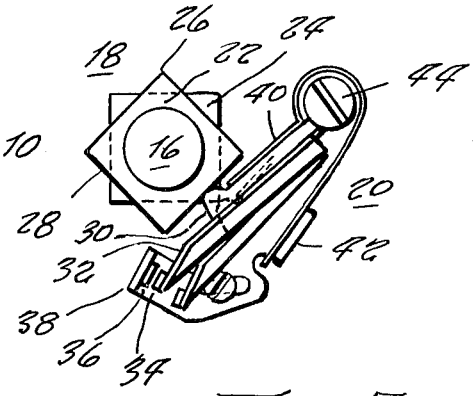
FIG. 2 is a plan view of the rotatable cams and breaker point assemblies arranged for alternate firing in an eight cylinder engine.
Figure 3:
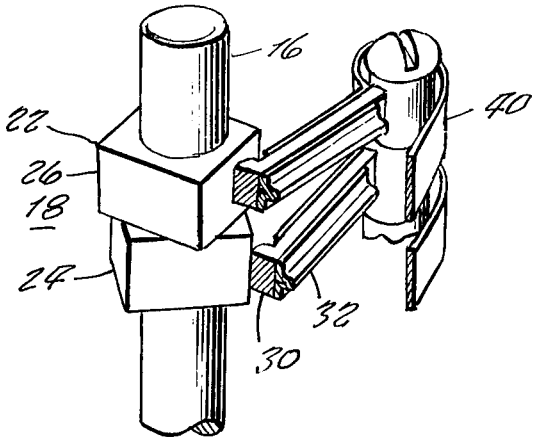
FIG. 3 is a fragmentary perspective view of the embodiment shown in FIG. 2.
Figure 4:
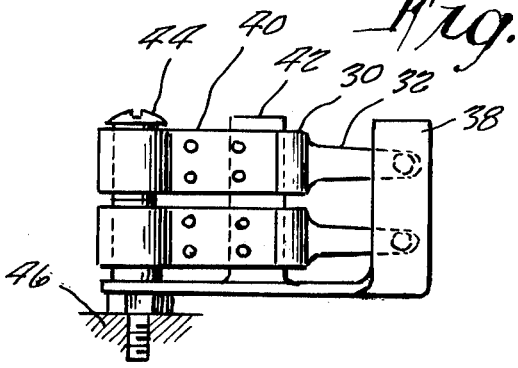
FIG. 4 is a side elevational view of the breaker point assemblies.

Referring now to FIGS. 2 through 4, there is shown one embodiment of the cam arrangement, in accordance with the present invention, and specifically for a two coil ignition system with alternate firing in an eight cylinder engine. In the figures there are shown two cams 22, 24 axially separated along the shaft 16. Each of the cams include a number of lobes 26 and a number of dwells 28 connected between the lobes. The cams are shown to be substantially identical.

The breaker point assemblies 20 each include an actuating cam follower 30 bounded on one side by a contact arm 32 having contact points 34 at one end thereof which mate with opposing contact points 36 mounted on a face plate 38. A biasing means, shown as a leaf spring 40 is coupled to the outer side of the actuating cam follower 30 and is held by the back plate 42. The actuating cam follower pivots about a pivot arm, shown as the screw 44 which can also be used to mount the breaker point assemblies onto the breaker plate 46.

In operation, as the driving shaft 16 is caused to rotate along with the crank-shaft of the engine, the cam assembly 18 will be caused to rotate. As each of the actuating cam followers 30 engage a lobe 26, the abutting contact points 34, 36 will break contact. As the actuating cam follower 30 engages a dwell 28, the leaf spring 40 will bias the contacts 34, 36 into a mating relationship therefore making the contact.

A stratified arrangement is formed between a plurality of cam means and a corresponding plurality of breaker point assemblies. While two such cams and breaker point assemblies are shown, it will be understood that a plurality of such cams and a corresponding plurality of breaker point assemblies could be utilized, each of which are arranged in an axially spaced apart position forming a stratified system of points and cams. The number of lobes which each of the cams would have, would be a function of the number of cylinders in the engine, the number of cams and the firing arrangement, as will hereinafter be explained.

Figure 7:
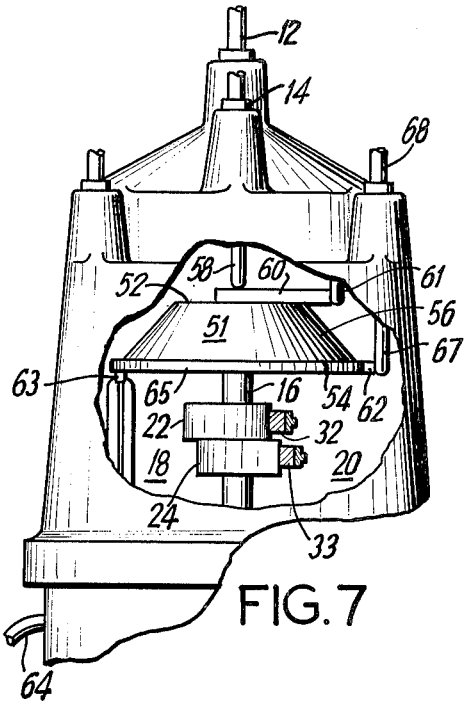
FIG. 7 is a partly cut-away elevational view of an ignition distributor of the present invention, and showing the multi-level rotor.

The present invention contemplates the use of multiple coils in conjunction with the multiple breaker point assemblies. Furthermore, to distribute the electrical current there is provided a multi-level rotor in the distributor. Referring now to FIG. 7, there is shown a two level rotor 51, which includes an upper level 52 and a lower level 54 interconnected by sides 56. Each of the levels of the rotor would be associated with a respective one of the cams 22, 24 and a corresponding one of the breaker point assemblies 32, 33. The upper level 52 includes a rotor contact lever 60 with a carbon brush 58 connecting to the contact lever 60. The outer terminals 61 are positioned at the periphery of the contact lever 60. For the lower level 54, a second carbon brush 63 is positioned against a ring or disc 65 on the lower rotor level 54 with a peripheral contact 62. Additional outer terminals 67 are provided on this level as well. The tips of contact lever 60 and peripheral contact 62 are axially aligned.

The distributor cap includes the conventional center feed terminal 12 which brings the secondary current from one of the ignition coils and interconnects to the carbon brush 58 providing secondary current to be distributed by the contact lever 60 which connect to terminals 61. The second carbon brush 63 is provided by a bottom feed 64 into the distributor cap and provides secondary current from a second ignition coil which is distributed by the lower disc 65. Terminals 67 extending from the external contacts 68 in the top of the distributor cap interconnect to the peripheral contact 62 on the lower disc 65.

Each level of the rotor is associated with a respective one of the cams. In this way, when the breaker point assembly 32 reaches a dwell on the cam surface 22 and opens the contacts, the upper rotor level 52 will be positioned to have one of the contact terminals 14 interconnected to the lever 60 to thereby provide secondary current flow to one of the spark plugs connected by the terminal 14. In a similar manner, when the lower breaker point assembly 33 opens its contact, the lower level rotor 54 will have a terminal 67 interconnected to the peripheral contact 62 thereby sending secondary coil delivered by the carbon brush 63 through the terminal 68 to its associated spark plug. While carbon brushes are described and are generally used, it is understood that any other type of resilient contact as is known in the art, could also be utilized.

Figure 13:
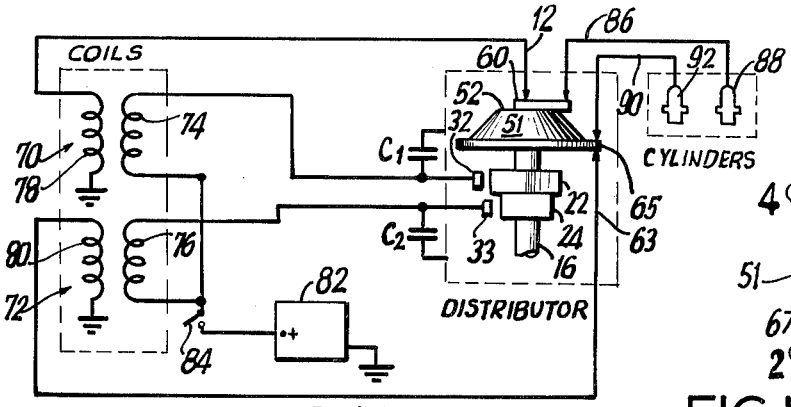
FIG. 13 is a schematic circuit diagram of the ignition system of the present invention, and FIGS. 14A, B and C show multi-level rotor layouts for a six cylinder, two coil ignition system and are respectively set for simultaneous operation, alternate operation, and phase shift operation.

Referring now to FIG. 13, there is shown an electrical circuit utilizing the ignition distributor of the present invention. The circuit is described for a two ignition coil arrangement, however additional coils could be added. The two ignition coils 70, 72 each have a primary 74, 76 and a secondary 78, 80. The primaries are connected in parallel with one end thereof connected to the battery 82 by means of the main ignition switch 84. The other end of the primaries are respectively connected to the breaker point assemblies 32, 33 in the distributor where the make and break of the circuits are under control of the respective cams 22, 24.

The secondary 78 is fed to the upper level 52 of the rotor by means of the conventional feed wire 12. The ignition wires 86 from the contacts on the rotor surface 52 feed spark plugs 88 positioned in the cylinders. The secondary 80 provides a bottom feed to the lower rotor level 54 by means of the contact 63. The ignition wires 90 connect to the contact on the lower disc 65 and provide current to other spark plugs 92 also positioned in the cylinders. Condensors $C_1$ and $C_2$ would be connected across the breaker point assemblies as are conventionally known in the art.

Figure 10:
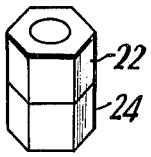
FIGS. 10 and 11 show, respectively, a perspective view and a plan view of the cam arrangement for simultaneous operation of two ignition coils in a six cylinder engine.
Figure 11:
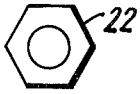
Figure 14A:
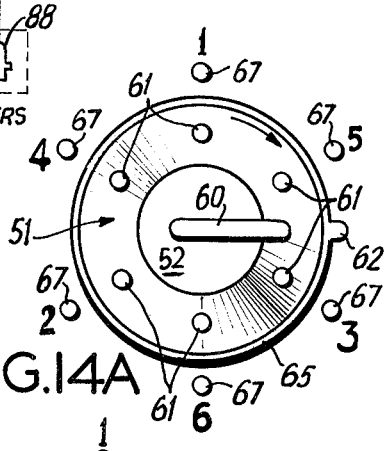

With the ignition distributor as described, numerous types of ignition arrangements can be set up. For example, the two cams can be axially aligned such that each of the cam followers simultaneously engage a respective lobe and a respective dwell whereby there will be simultaneous breaking of each of the break point assemblies. In such case, each of the cams would have a number of lobes equal to the number of cylinders, and each of the cylinders would have a number of spark plugs therein equal to the number of ignition coils. For example, as shown in FIGS. 10 and 11, the cams 22, 24 are shown with six lobes each, suitable for operation of a six cylinder engine. Both cams are aligned so that the break point assemblies would operate simultaneously. Utilizing two cams, there would be provided two break point assemblies and two ignition coils. Furthermore, there would be two spark plugs in each of the cylinders. The dual level rotor arrangement would be as shown in FIG. 14A, where both the upper level 52 and the lower level 54 would have identically corresponding contacts to engage the respective contact terminals extending into the distributor cap. The contact arrangement is shown for a typical firing order of a six cylinder engine, and is of the firing order 1, 5, 3, 6, 2, 4.

With such aligned arrangement, each breaker point assembly would be interconnected with its own respective ignition coil and all of the coils would fire simultaneously, whereby the two spark plugs would fire simultaneously in each respective cylinder. Such simultaneous firing in each cycle for each cylinder would provide higher power, better combustion, and improved efficiency of operation.

Figure 8:
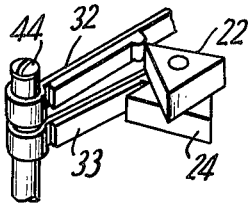
FIG. 8 is a schematic perspective view of the cams and breaker point assemblies arranged for alternate operation in a six cylinder engine.
Figure 9:
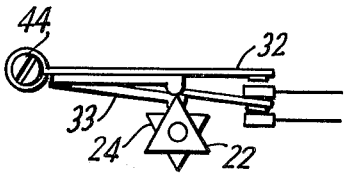
FIG. 9 is a schematic plan view of the embodiment shown in FIG. 8.

A second arrangement of the cams can provide for alternate operation of the ignition coils in alternate cylinders. In such arrangement, the cams are positioned in axially angled position with respect to each other to thereby provide sequential operation of the breaker point assemblies. For example, referring to FIGS. 8 and 9, there are shown two cams 22, 24 each having three lobes each and being angularly shifted by 60° with respect to each other. Two breaker point assemblies 32, 33 are provided on the common pivot 44. When one of the breaker point assemblies 32 encounters a lobe of its respective cam 22, the other assembly 33 encounters a dwell on its cam 24.

Figure 14B:
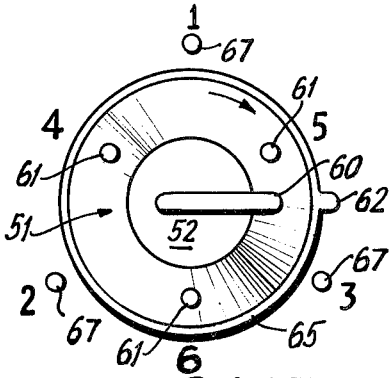

For the arrangement shown, there would be two ignition coils for the two breaker point assemblies and a single spark plug in each one of the six cylinders. The two level rotor arrangement would be as shown in FIG. 14B where half the number of contacts would be provided on each of the rotor levels. Although the standard conventional firing order for six cylinders is maintained, the rotors alternate in providing such firing. Thus, the lower rotor provides the firing for cylinders 1, 3 and 2, while the upper rotor provides the firing for cylinders 5, 6 and 4. In this arrangement, each of the ignition coils fire alternately and only a single spark is provided for each one of the cylinders. In this manner, each of the breaker point assemblies only operate one half the number of times compared to conventional single breaker point assembly systems and furthermore, the dwell time of each breaker point assembly is greater than in conventional single breaker point assemblies. As a result, a higher voltage can be built up and better performance will be achieved even at higher speeds and having a greater number of cylinders.

It should be noted, that the embodiment shown in FIGS. 2 and 4, have cams with four lobes each and have the cams angularly shifted 45° with respect to each other. This arrangement, utilizing two coils corresponding to the two breaker point assemblies, would be for an eight cylinder engine with a single spark plug in each cylinder and having the ignition coils operating alternately.

Figure 12:
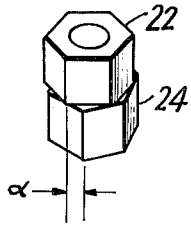
FIG. 12 shows a perspective view of the cam arrangement for adjusting the flame propagation in a six cylinder engine.
Figure 14C:
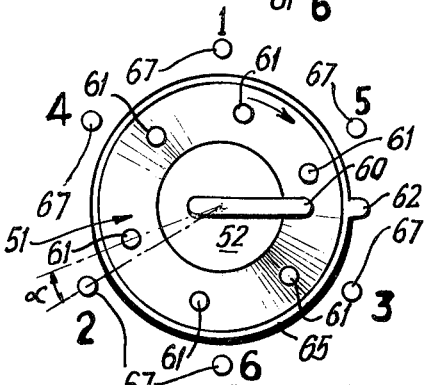

It is also possible to arrange for a phase shift to produce consecutive firing of spark plugs in each cylinder to provide a flame propagation arrangement. Such arrangement would include identical cams angularly shifted a fixed number of degrees with respect to each other. For example, referring to FIG. 12, there are shown the two identical cams 22, 24 having six lobes each. The cams are angularly shifted with respect to each other an amount of $\alpha°$. Such cam system could be utilized for a six cylinder engine having two spark plugs in each cylinder with two ignition coils respectively for the two breaker point assemblies. Each breaker point assembly would operate for each one of the cylinders and provide a spark for each of the cylinders at each cycle. However, the sparks would be angularly spaced based upon the phase shift $\alpha$ provided. The rotor arrangement for such flame propagation is shown in FIG. 14C. It is noted that each one of the rotor levels contain six contacts in sequence according to the conventional firing order for a six cylinder engine. However, the contacts are angularly spaced apart at an angle $\alpha$ corresponding to the phase shift provided between the cams. With such arrangement, each ignition coil will cause a spark to be fired in each and every one of the cylinders for each and every cycle. However, the spark plugs will not fire simultaneously in each cylinder but will fire alternately in each cylinder with the delay being dependent upon the angle of phase shift provided.

The ability to vary the firing angle between successive ignition sparks within the same cylinder permits accommodation for engine configurations requiring irregular firing cycles. The irregular firing cycle is accommodated by altering the relative phase angle between the lobes of adjacent cams. Such ability to change the relationship can find specific benefit in the compound vortex controlled combustion engine (CVCC). In such engines, there is included a small combustion chamber just above the main chamber of the cylinders. In many such engines, the small chamber includes a spark plug of its own, aside from the spark plug in the main chamber. The two chambers are interconnected by a narrow passageway. A rich air-fuel mixture is applied into the small chamber while a lean air-fuel mixture is supplied in the main chamber, to form distinct layers of the blend of mixtures. In this type of engine, the spark plugs of both the small chamber and the large chamber must be ignited simultaneously, while on the other hand, each of the cylinders must be ignited sequentially. Utilizing the system of the present invention, it is possible to have each of the small chambers associated with one of the breaker point assemblies while the spark plugs in the main chambers can all be associated with a second break point assembly. Utilizing the two separate coils, with each of the coils utilized in conjunction with a respective one of the breaker point assemblies, both breaker point assemblies will operate simultaneously, one acting to ignite the spark plug in the larger main chamber. However, each chamber and its related cylinders will ignite sequentially in accordance with the desired firing cycle.

Another possible variation utilizing the present invention is to combine initial simultaneous firing with subsequent phase shift firing and have the change take place as a result of temperature control. Thus, each of the cams would be provided with a number of lobes equal to the number of cylinders. Both cams could be substantially identical and would be initially in alignment with each other. Each of the breaker point assemblies would be be provided with its own ignition coil and there would be provided two rotor levels each with the same number of contacts. Initially the rotor levels would be aligned with each other. There would be two spark plugs in each of the cylinders.

When starting the vehicle, both ignition coils would operate simultaneously providing simultaneous firing of the spark plugs in each cylinder. With this arrangement, increased power is provided at the beginning when the engine is cold in order to ensure adequate burning and sufficient power to maintain suitable operation of the engine. A temperature control means is included to shift the phase angle between the cams and between the rotor levels, based upon a specified temperature. For example, the temperature control can be arranged so that at approximately 150° F. the angular shift occurs whereby the cams would be at a phase angle dfference with each other. The rotor level would also be similarly shifted. Therefore after the engine is sufficiently heated, although both spark plugs will still fire in each cylinder for each cycle, the two sparks in each cylinder would be at a timed relationship with each other based upon the phase angle shift between the cams.

Figure 5:
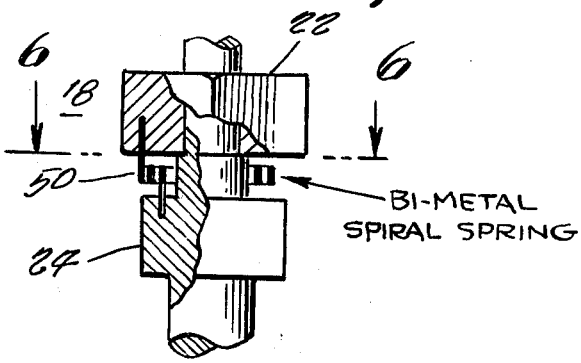
FIG. 5 is a partially sectioned side view of another embodiment of the rotatable cams, and showing temperature adjustable control.
Figure 6:
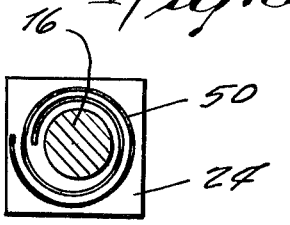
FIG. 6 is a cross-sectional view taken along line 6—6 of FIG. 5.

Referring now to FIG. 5, there is shown one embodiment providing such temperature shift. The cam assembly 18 contains the upper cam 22 and the lower cam 24 spaced apart with a temperature responsive element therebetween, and shown by way of example as a bimetal spiral spring 50. By utilizing the arrangement shown in FIGS. 5 and 6, it is possible to change the relationship of the lobes between adjacent cams. When the temperature desired is reached, the spring twists to displace the two cams into angular relationship with each other. This permits flame propagation after the engine is heated up. It should be appreciated, that the embodiment shown in FIGS. 5 and 6, combine the features of the embodiment shown in FIG. 10 of simultaneous firing, with the embodiment shown in FIG. 12 of angularly spaced firing.

By utilizing the present invention, it is noted that it is relatively simple to replace a conventional single coil ignition system using a single breaker point assembly and a single cam lying in the same place of the breaker point assembly, with the system of the present invention. Since all of the breaker point assemblies are stratified and utilize a common pivot arm onto a common ground plate, the single breaker point assembly of a conventional ignition distributor can be removed and the stratified breaker point assemblies can be replaced directly in the same hole available for the original assembly. Thus, it is not needed to replace the entire breaker plate and accordingly it is not necessary to replace the entire distributor assembly. Furthermore, the single cam of the conventional distributor can be removed and the stratified cams of the present invention can be inserted without the necessity of replacing the entire shaft or the entire distributor unit.

Utilizing the arrangement of the aforedescribed invention, it is possible to obtain an ignition distributor which provides longer life than conventional distributors and at the same time provides lower maintenance problems and less frequent tune-ups. Furthermore, the distributor of the present invention has a lower cost for initial manufacture and installation of the unit. Furthermore, the associated wiring circuits and related parts are simplier than most multi-point ignition systems. The present invention provides easier starts and better performance, especially at higher speeds where longer dwells are needed. Additionally, the invention is versatile in that it can be adapted to ignite either one or two spark plugs per cylinder and provide either sequential or simultaneous igniting of the spark plugs.

While certain novel features of this invention have been shown and described and are pointed out in the annexed claims, it will be understood that various omissions, substitutions and changes in the forms and details of the device illustrated and in its operation can be made by those skilled in the art, such as the use of a plurality of magnetic pickup coils in the same pivot line, and the arrangements of reluctors or magnetic pulse distributors on driving shaft in place of cams to realize the previously mentioned benefits without departing from the spirit of the invention.

What is claimed is:

1. An ignition system for a multi-cylinder internal combustion engine comprising in combination, a driving shaft, a plurality of rotatable cam means mounted on said shaft in an axially spaced arrangement, each of said cam means having a number of lobes for actuating one of a plurality of substantially identical and concurrently operable circuit breaker assemblies disposed in an axially spaced arrangement, each said circuit breaker assemblies including an actuating cam follower, all of said cam followers being pivoted about the same pivot arm, said pivot arm being affixed to a common ground plate and each of said cam followers engaging a respective one of said cams, a multi-level distributor cover means having at least one terminal contact disposed on each level, a multi level rotor mounted on said driving shaft and rotating within said distributor cover means, a plurality of ignition coils having primary and secondary windings, said ignition coils corresponding in number to the number of levels of said multi-level rotor and said primary windings being connected to a respective one of said breaker assemblies at one end and to a power source at the other end, said multi-level rotor including an input connection for each level connected to a respective one of said secondary windings, each level of said multi-level rotor having an axially spaced and axially aligned output connection tip, said output connection tips having a different radius for each level and connecting the input of each rotor level with said at least one contact on the corresponding level of the multi-level distributor cover means, said contacts being connected to the engine spark plugs.

2. The combination of claim 1 and wherein said cam means are arranged whereby axially adjacent lobes of said cam means are aligned to actuate respective circuit breaker assemblies in conjunction causing said ignition coils to produce firings on 0° angular varinace.

3. The combination of claim 2 wherein each rotor level operates a number of contacts equal in number to the number of cylinders, wherein corresponding contacts associated with all rotor levels are in alignment, and wherein the number of lobes on each cam are equal to the number of cylinders, whereby all ignition coils fire in conjunction for each cylinder on 0° angular variance.

4. The combination of claim 1 and wherein said cam means are arranged such that axially adgascent lobes of said cam means are angularly displaced with respect to each other to alter the relative phase angle, such that there exists a fixed angular relationship between axially adjacent lobes of said cam means, whereby lobes on each of said cam means actuate respective circuit-breaker assemblies to produce a firing angle providing the phase difference between successive ignition firings.

5. The combination of claim 4 and wherein each rotor level operates a number of contacts equal in number to the number of cylinders, corresponding contacts on adjacent rotor levels being of said fixed angular relationship with each other, and wherein the number of each cam are equal in number to the number of cylinders, whereby all said ignition coils fire for each cylinder in a sequential arrangement with the delay being dependent upon the angle of phase shift provided.

6. The combination of claim 4 and wherein each rotor level operates a number of contacts equal in number to the number of cylinders divided by the number of levels, adjacent levels being at said fixed angular relationship with each other, and wherein the number of lobes on each cam are equal in number to the number of cylinders divided by the number of cams, whereby said coils fire sequentially with one coil firing for each cylinder.

7. The combination of claim 1 and further comprising a spacing means positioned between adjacent ones of said cam means, said spacing means including a temperature responsive element which varies the angular relationship between adjacent cam means based upon the temperature of the engine.

8. The combination of claim 7 and including a pair of substantially identical cam means, one of which is fixed on said shaft, and wherein said cam means are initially aligned causing simultaneous firing of the ignition coils for each cylinder, and wherein said spacing means alters the relative phase angle between said cam means based upon the temperature of the engine to thereby vary the firing angle between successive ignition firings for each cylinder after a predetermined fixed temperature.

9. The combination of claim 1 and wherein said cam means are (fixedly positioned) arranged with respect to each other such that there exists an equal angular relationship between axially adjacent lobes of said cam means, so that lobes on axially adjacent cam means are non-aligned causing respective cam means to actuate respective circuit breaker assemblies (alternately) one half the number of times per cycle, thereby respectively coupled ignition coil fore for respectively connected cylinder one half the number of times per cycle.

10. The combination of claim 1 wherein each of said circuit breaker assemblies includes a contact lever arm connected to and extending from said actuating cam follower, a first contact point connected to the end of said contact lever arm, a face plate having a second contact point facing said first contact point, spring means coupled to said cam follower for biasing said first and said second contact points into mating relationship, wherein said face plates of all said breaker point assemblies are interconnected, and wherein said actuating cam follower is formed of insulating material.

11. The combination of claim 1 and comprising a pair of cams, a pair of circuit breaker assemblies, and a pair of ignition coils, and further comprising a distributor housing means, a top feed means in said housing means for coupling the secondary of one of said coils to the upper rotor level, and a bottom feed means in said housing means for coupling the secondary of the other of said coils to the lower rotor level.

12. The combination of claim 11 and wherein each of said feed means includes a resilient contact means for electrical connection to its respective rotor level.

* * * * *